US007223104B2

(12) United States Patent
Suenaga

(10) Patent No.: US 7,223,104 B2
(45) Date of Patent: May 29, 2007

(54) ROTARY CONNECTOR DEVICE

(75) Inventor: Katsuyuki Suenaga, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/396,597

(22) Filed: Apr. 4, 2006

(65) Prior Publication Data

US 2007/0004236 A1 Jan. 4, 2007

(30) Foreign Application Priority Data

Jul. 1, 2005 (JP) ..... 2005-193969

(51) Int. Cl.
*H01R 39/00* (2006.01)

(52) U.S. Cl. ..... 439/15; 439/164

(58) Field of Classification Search ..... 439/15, 439/164

See application file for complete search history.

(56) References Cited

U.S. PATENT DOCUMENTS 4,849,586 A * 7/1989 Ida et al. ..... 200/61.54
5,100,331 A * 3/1992 Banfelder ..... 439/15
6,371,779 B2 * 4/2002 Matsumoto ..... 439/164
6,764,326 B2 * 7/2004 Matsumoto et al. ..... 439/164
2001/0007799 A1 * 7/2001 Matsumoto ..... 439/164
2007/0004236 A1 * 1/2007 Suenaga ..... 439/15

FOREIGN PATENT DOCUMENTS

JP 2003-151711 5/2003
JP 2003-243119 8/2003

* cited by examiner

*Primary Examiner*—James R. Harvey
(74) *Attorney, Agent, or Firm*—Finnegan, Henderson, Farabow, Garrett & Dunner, L.L.P.

(57) ABSTRACT

A rotary connector device includes a stator, a rotor rotatably fitted to the stator, a cable chamber surrounded by the stator and the rotor and also formed around a rotating center of the rotor circumferentially, a flexible flat cable accommodated in the cable chamber so as to allow rotating of the rotor in relation to the stator, the cable having one end led to the stator and another end led to the rotor, and a slip ring mechanism having two conductive rings fixed to the stator and two sliding terminals fixed to the rotor. The stator has a stationary top face part formed so as to cover an upside of the cable chamber, while the rotor has a rotary top face part formed so as to adjoin the stationary top face part of the stator. The slip ring mechanism is arranged in a clearance between the stationary top face part of the stator and the rotary top face part of the rotor.

7 Claims, 6 Drawing Sheets

ROTARY CONNECTOR DEVICE

BACKGROUND OF THE INVENTION

The present invention relates to a rotary connector device for electrically connecting a stator member, such as steering column of an automobile, to a rotor member, such as steering wheel.

Japanese Patent Publication laid-open Nos. 2003-151711 and 2003-243119 disclose this kind of rotating connector devices. Each of the rotating connector devices comprises a stator fixed to a steering column, a rotor fixed to a steering wheel and rotatably assembled to the stator, a cable chamber arranged in the rotor and the stator and formed circumferentially around a rotating center of the rotor, a flexible flat cable accommodated in the cable chamber so as to allow a rotation of the rotor, the flexible flat cable having one end led toward the stator and the other end led toward the rotor, and a slip-ring mechanism. The slip-ring mechanism includes conductive rings fixed to the rotor and arranged around the rotating center of the rotor and sliding terminals arranged on the stator to slide on the conductive rings.

In operation, when the steering wheel is rotated, the rotor rotates in relation to the stator. For the rotation of the rotor, the flexible flat cable maintains an electrical connection between the stator and the rotor while changing its accommodated condition in the cable chamber. On the other hand, the sliding terminals maintain the electrical connection between the stator and the rotor while sliding on the conductive rings. In case of small conducting current flowing between the steering column and the steering wheel (e.g. ignition signal for air bag), a conducting route in the flexible flat cable is employed. To the contrary, in case of large conducting current (e.g. current for steering heater), a conducting route in the slip ring mechanism is employed.

Meanwhile, the above slip ring mechanism is positioned below the cable chamber in the following manner. In case of Japanese Patent Publication laid-open No. 2003-151711, a rotor has a shaft part formed to project from a cable chamber downwardly. The shaft part is provided with a projecting brim part to which conducting rings are fixed. On the other hand, a stator has a projecting part formed to project from the cable chamber downwardly. Terminal attachments are fixed to the projecting part of the stator by screws. The above-mentioned sliding terminals are fixed to the terminal attachments.

In the above-constructed slip ring mechanism, however, the number of components forming the mechanism is large to cause a rise in its manufacturing cost due to the structure where the sliding terminals are attached to the stator with the use of the sliding terminals. Additionally, since it is necessary to provide the stator with an exclusive space below the cable chamber to accommodate the slip ring mechanism, a dimension of the rotary connector device is increased in its axial direction, causing the device to be large-sized. Further, as mentioned above, the rotor has to be provided, as an exclusive attachment portion, with the brim part for the conductive rings of the slip ring mechanism.

SUMMARY OF THE INVENTION

Under the circumstances, it is therefore an object of the present invention to provide a rotary connector device that enables the number of components forming the slip ring mechanism to be reduced and also enables the slip ring mechanism to be installed in a narrow space in the axial direction and that can eliminate the use of an exclusive attachment portion like the brim part in installing the slip ring mechanism.

In the first aspect of the present invention, the object described above can be accomplished by a rotary connector device comprising: a stator; a rotor rotatably fitted to the stator; a cable chamber surrounded by the stator and the rotor and also formed around a rotating center of the rotor circumferentially; a cable accommodated in the cable chamber so as to allow rotating of the rotor in relation to the stator, the cable having one end led to the stator and another end led to the rotor; and a slip ring mechanism having at least one conductive ring fixed to either one of the rotor and the stator, and at least one sliding terminal fixed to the other one of the rotor and the stator and also configured to slip on the conductive ring, wherein the stator has a stationary top face part formed so as to cover an upside of the cable chamber, while the rotor has a rotary top face part formed so as to adjoin the stationary top face part of the stator; and the slip ring mechanism is arranged in a clearance between the stationary top face part of the stator and the rotary top face part of the rotor.

According to the first aspect of the present invention, since the conductive ring and the sliding terminal can be directly fixed to, for example, the stationary top face part of the stator and the rotary top face part of the rotor respectively, there is no need of preparing any attachment component besides the conductive ring and the sliding terminal in attaching the slip terminal to the rotary connector device. Therefore, the number of components forming the rotary connector device can be reduced in comparison with the conventional device having the brim part mentioned above, whereby the manufacturing cost can be saved.

Additionally, since the installation of the slip ring mechanism can be effected while utilizing the clearance defined between the stationary top face part of the stator and the rotary top face part of the rotor, it is possible to arrange the slip ring mechanism in a narrow space in the axial direction of the rotary connector device, accomplishing its miniaturization. Moreover, due to the arrangement of the slip ring mechanism between the stationary top face part of the stator and the rotary top face part of the rotor, both of which cover the upside of the cable chamber, the slip ring mechanism is not exposed to an outside of the rotary connector device, preventing an invasion of foreign particles into the device and an occurrence of noise and/or sliding sound from the device.

In the second aspect of the invention, in the rotary connector device, the at least one conductive ring of the slip ring mechanism is fixed to the stationary top face part of the stator, while the at least one sliding terminal of the slip ring mechanism is fixed to the rotary top face part of the rotor.

According to the second aspect of the present invention, it is possible to obtain effects similar to those of the first aspect of the invention.

In the third aspect of the invention, in the rotary connector device, the stator includes a cylindrical main housing and an annular under plate assembled to a bottom face of the main housing; and the rotor includes an upper rotary member having a shaft part formed so as to penetrate both of the cylindrical main housing and the annular under plate of the stator and a lower rotary member for engagement with the shaft part of the upper rotary member; and the stator is interposed between the upper rotary member and the lower rotary member of the rotor.

According to the third aspect of the invention, since the stator is interposed between the upper rotary member and the lower rotary member of the rotor, the rotation of the rotor can be stabilized due to holding effect by the stator.

In the fourth aspect of the invention, in the rotary connector device of the third aspect, the cable chamber is defined between an outer circumferential wall forming the cylindrical main housing of the stator and an inner circumferential wall forming the shaft part of the upper rotary member of the rotor.

According to the fourth aspect of the present invention, since the cable chamber is annular-shaped between the outer circumferential wall of the stator and the inner circumferential wall of the rotor, it is possible to accommodate the cable in the cable chamber annularly, saving an installation space for the cable.

In the fifth aspect of the invention, in the rotary connector device of the first aspect, the slip ring mechanism includes a plurality of conductive rings arranged about the rotating center of the rotor concentrically and a plurality of sliding terminals corresponding to the conductive rings respectively.

According to the fifth aspect of the present invention, owing to the concentric arrangement of the conductive rings, it is possible to save an installation space for the conductive rings while ensuring each electrical connection between the conductive rings and the corresponding sliding terminals.

In the sixth aspect of the invention, the rotary connector device of the first aspect further comprises a ring-shaped carrier accommodated in the cable chamber to carry the cable and a plurality of idlers rotatably carried by the ring-shaped carrier, wherein the cable is a flexible flat cable.

According to the sixth aspect of the present invention, owing to the provision of the carrier and the idlers, it is possible to stably accommodate the flexible flat cable in the cable chamber, irrespective of rotating state of the rotor.

In the seventh aspect of the invention, the rotary connector device of the first aspect further comprises a steering wheel of a vehicle and a steering column of the vehicle, wherein the stator is fixed to the steering column, while the rotor is fixed to the steering wheel.

According to the seventh aspect of the present invention, once the rotary connector device is built in the vehicle, a downward pressure is applied from the steering wheel to the rotor, urging the sliding terminal against the conductive ring. Therefore, it is possible to prevent the rotary connector device itself from chattering due to vibrations etc. Additionally, since the cable can be connected to the steering wheel through the rotor just below it, it is possible to reduce an adverse effect (e.g. noise) of great current flowing in the slip ring mechanism on the cable, adjacent wires, electronic components and so on.

These and other objects and features of the present invention will become more fully apparent from the following description and appended claims taken in conjunction with the accompany drawings.

DESCRIPTION OF THE PREFERRED EMBODIMENT

Figure 1:
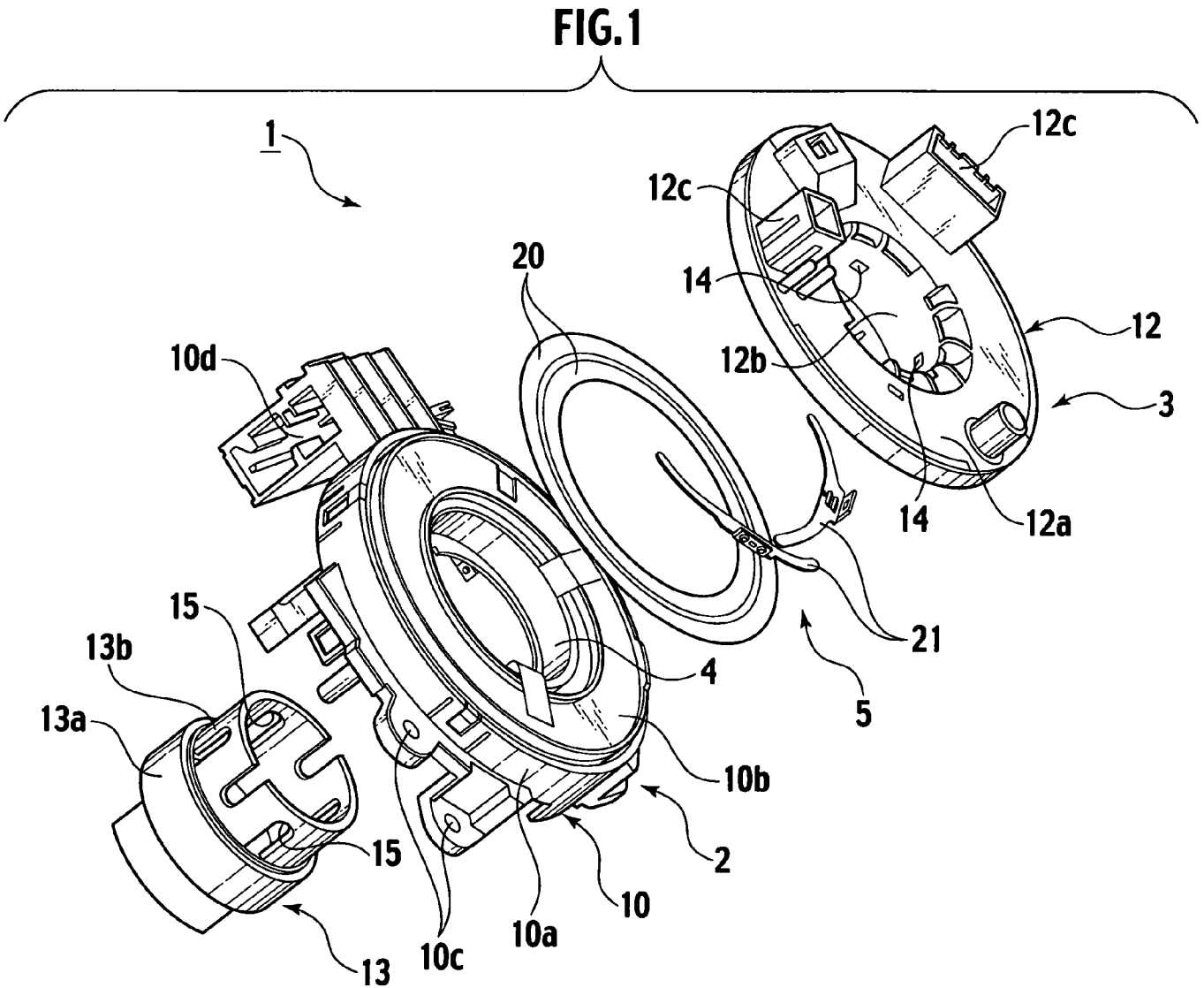
FIG. 1 is an exploded perspective view of a rotary connector device in accordance with an embodiment of the present invention.
Figure 2:
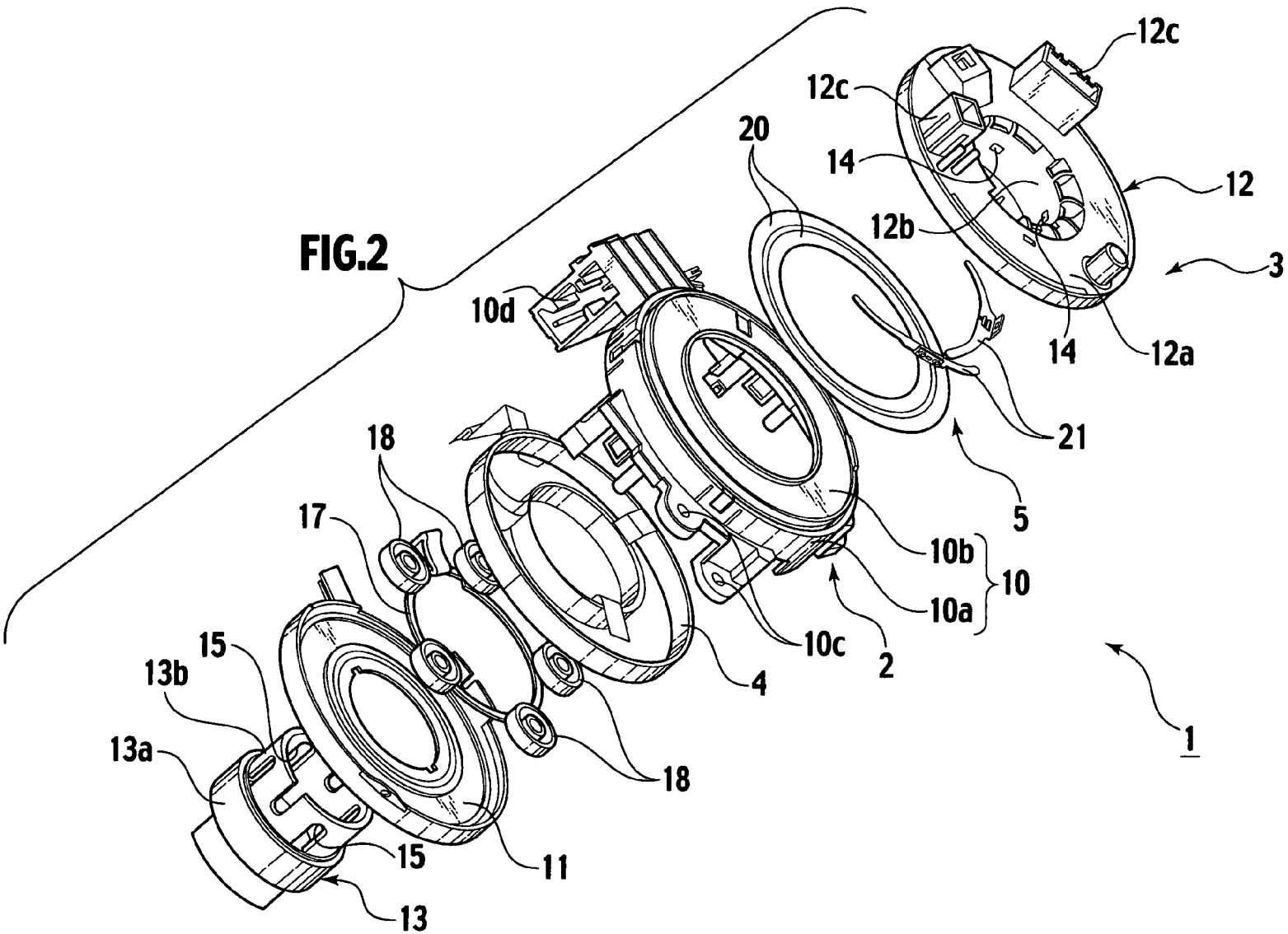
FIG. 2 is an exploded perspective view of the rotary connector device in accordance with the embodiment of the present invention, also showing an interior of a stator forming the rotary connector device.
Figure 3:
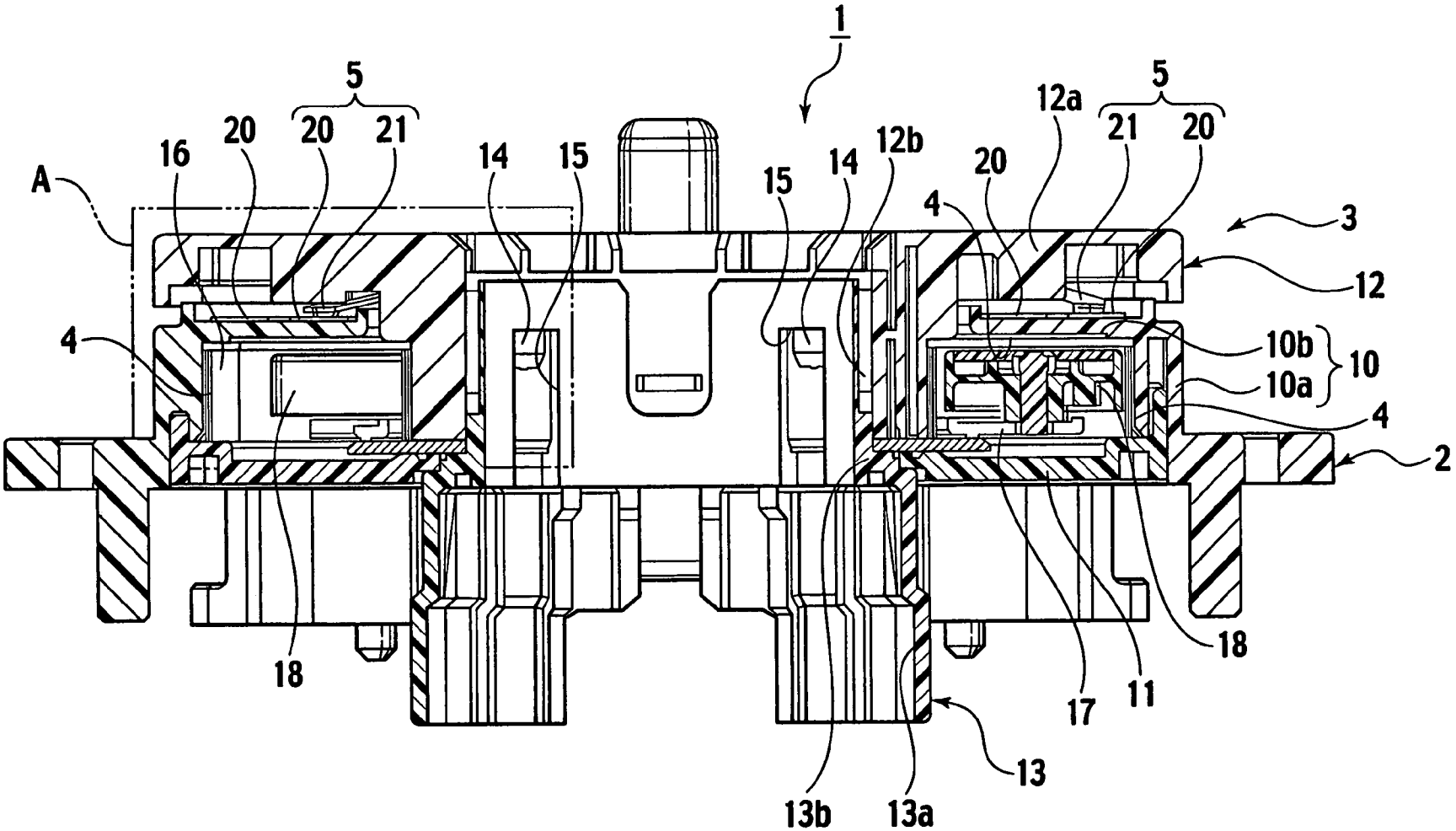
FIG. 3 is a sectional view of the rotary connector device of the embodiment of the present invention.
Figure 4:
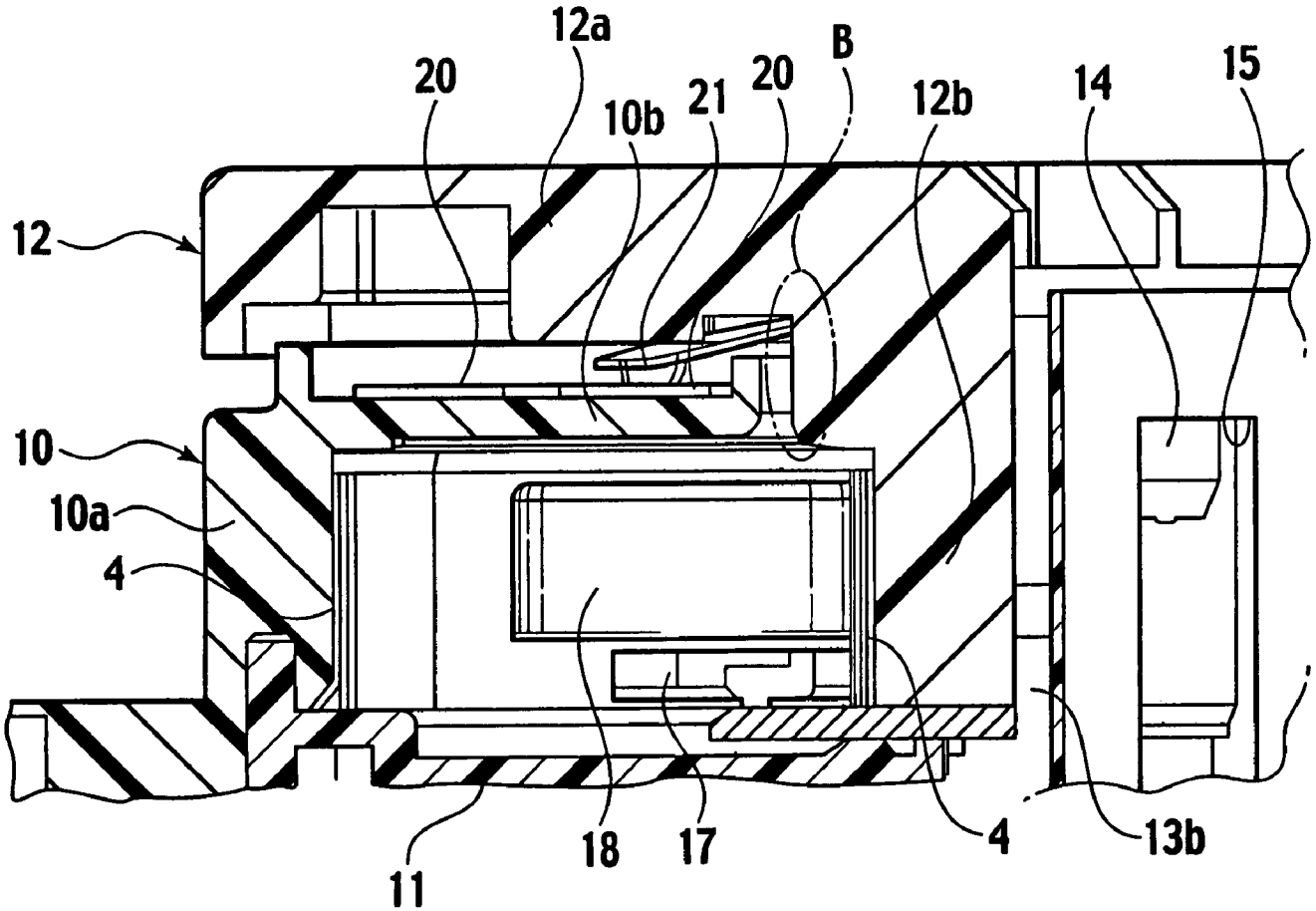
FIG. 4 is an enlarged view of a part A of FIG. 3, showing the embodiment of the present invention.
Figure 5:
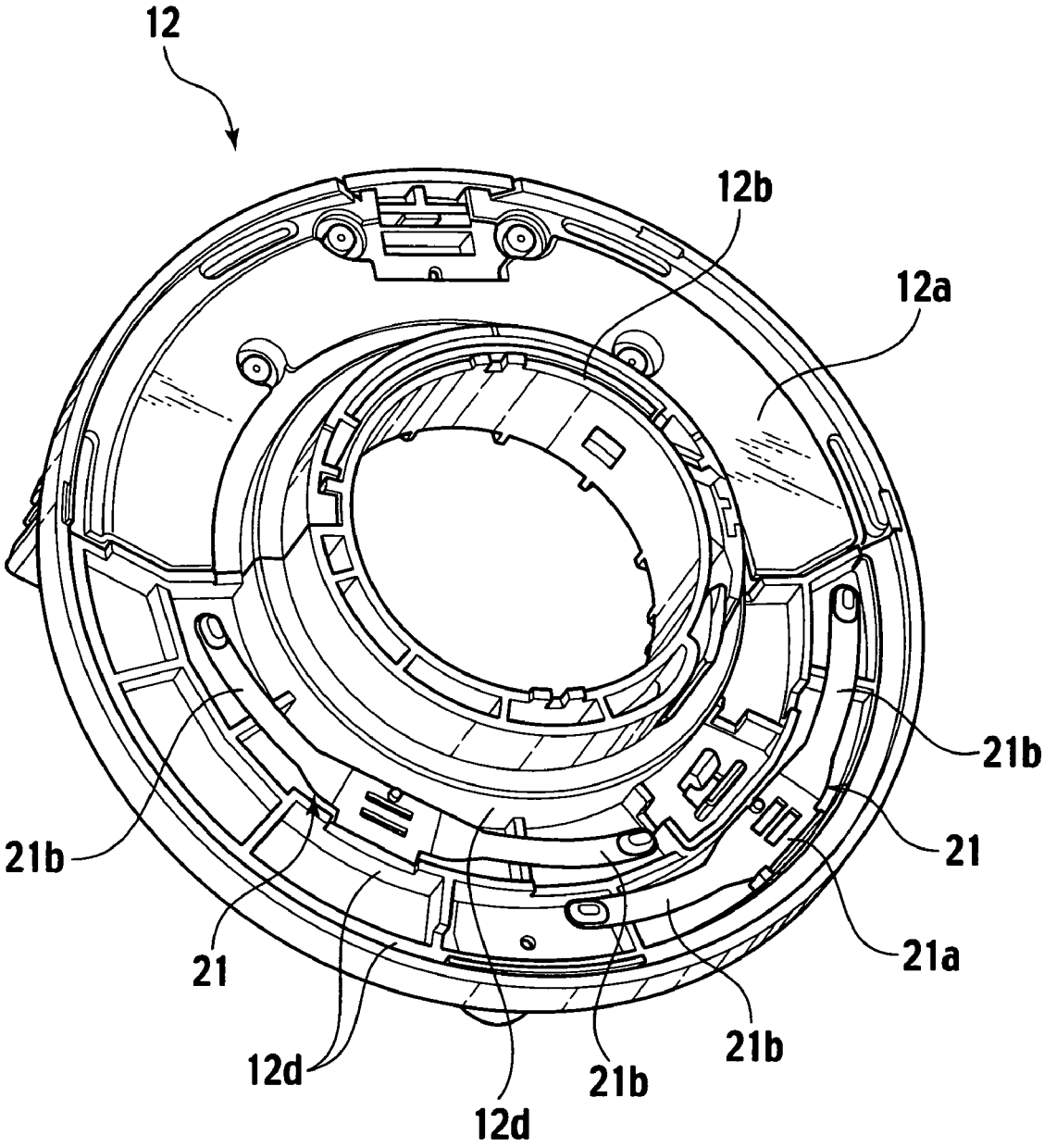
FIG. 5 is a perspective view of an inside of an upper rotating member having a sliding terminal attached thereto, showing the embodiment of the present invention.
Figure 6:
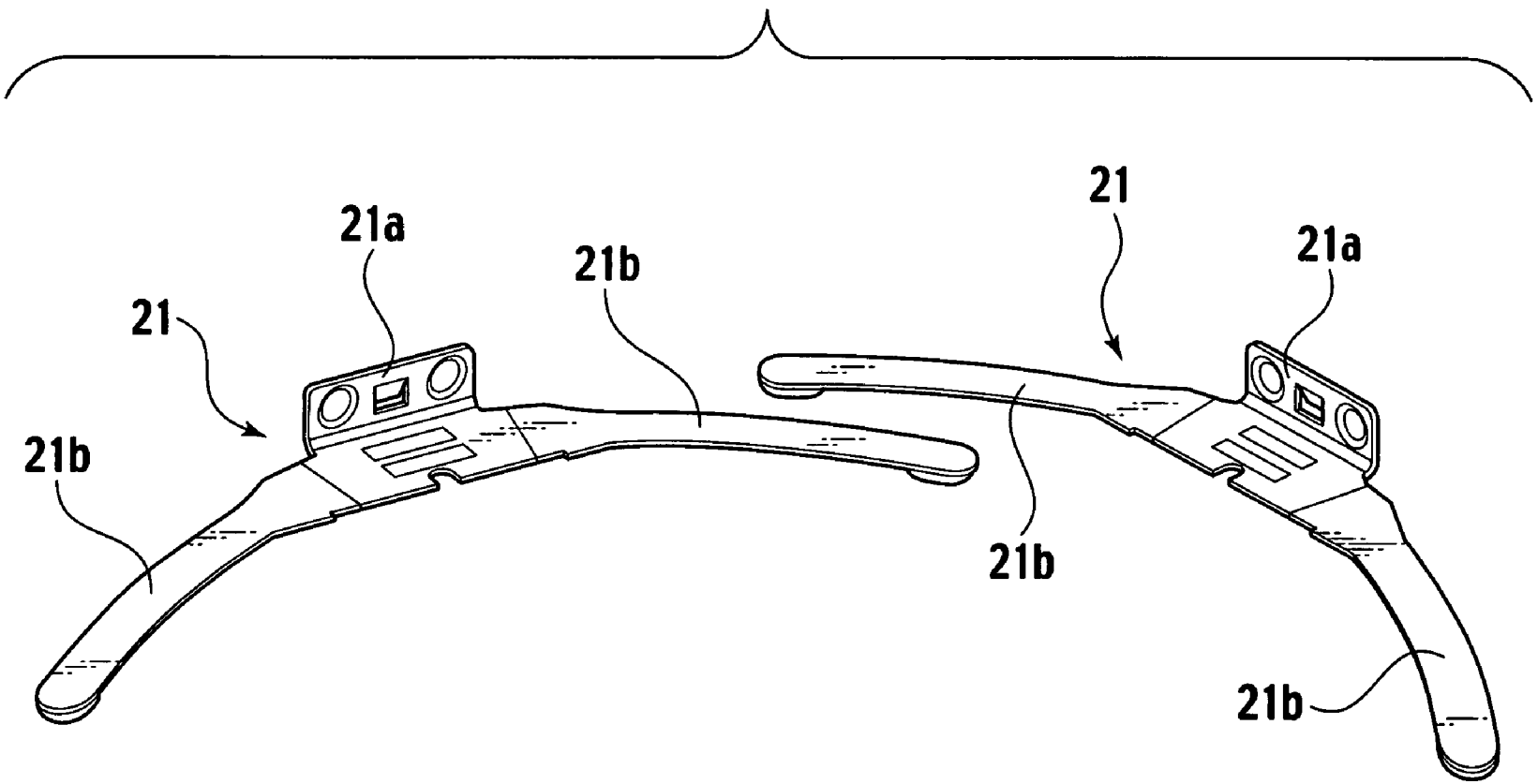
FIG. 6 is a perspective view of the sliding terminal, showing the embodiment of the present invention.

An embodiment of the present invention will be described with reference to the drawings. FIG. 1 shows one embodiment of the present invention. FIG. 1 is an exploded perspective view of a rotary connector device. FIG. 2 is an exploded perspective view of the rotary connector device, in which an interior of a stator is also exploded. FIG. 3 is a sectional view of the rotary connector device. FIG. 4 is an enlarged view of a part A of FIG. 3. FIG. 5 is a perspective view of an inner side of an upper rotating member having a sliding terminal attached thereto. FIG. 6 is a perspective view of the sliding terminal.

As shown in FIGS. 1 to 3, the rotary connector device 1 comprises a stator 2 fixed to a steering column (not shown), a rotor 3 fixed to the steering column and rotatably fitted in the stator 2, a flexible flat cable 4 for attaining an electrical connection between the rotor 3 and the stator 2 and a slip ring mechanism 5 for also attaining the electrical connection between the rotor 3 and the stator 2.

The stator 2 is formed by a cylindrical main housing 10 and an annular under plate 11 assembled onto a bottom face of the main housing 10. The main housing 10 includes a cylindrical outer circumferential wall 10*a*, an annular stationary top face part 10*b* arranged on the upper end of the outer wall 10*a* integrally, a plurality of attachments 10*c* projecting from the outer wall 10*a* at its proper positions and a stationary connector part 10*d* projecting from the outer wall 10*a*. The stator 2 is fixed to the steering column through the attachments 10*c* by means of screws or the likes. The steering column has wiring cables connected to the stationary connector part 10*d* of the stator 2.

The rotor 3 is formed by an upper rotary member 12 and a lower rotary member 13. The above stator 2 is interposed between the upper rotary member 12 and the lower rotary member 13. The upper rotary member 12 is provided with engagement claws 14. On the other hand, the lower rotary member 13 is provided with engagement holes 15. With engagement of the engagement claws 15 in the engagement holes 15, the upper rotary member 12 and the lower rotary member 13 are locked on each other integrally.

The upper rotary member 12 includes a disc-shaped rotary top face part 12*a* to be arranged above the stationary top face part 10*b* of the main housing 10 and a shaft part (inner circumferential wall) 12*b* hung from an inner circumferential edge of the rotary top face part 12*a*. The rotary top face part 12*a* is provided, on a fop face thereof, with a plurality of rotary connector parts 12*c* at several positions. Also, the steering column has wiring cables connected to the rotary connector parts 12*c* of the rotor 3. The shaft part 12*b* is arranged so as to penetrate the interior of the stator 2. The rotor 3 is adapted so as to rotate about the shaft part 12*b* as a rotating center. The above engagement claws 14 are formed on an inner face of the shaft part 12*b* at appropriate positions.

The lower rotary member 13 is formed by a large-diameter cylindrical part 13*a* having a large diameter and an upper cylindrical part 13*b* having a diameter smaller than the large diameter of the part 13*a* and projecting from it upwardly. In assembly, the upper cylindrical part 13*b* is inserted into lo the shaft part 12*b*. The above engagement holes 15 are formed in the upper cylindrical part 13*b* at appropriate positions.

Inside both the stator 2 and the rotor 3, a cable chamber 16 is defined about the rotating center of the rotor 3 circumferentially. In the annular cable chamber 16, its outer circumferential side face is covered by the outer wall 10*a* of the stator 2, a chamber's top face covered by the stationary stationary top face part 10*b*, a chamber's bottom face covered by the under plate 11, and a chamber's inner circumferential side face is covered by the shaft part 12*b* of the upper rotary member 12.

The flexible flat cable 4 is accommodated in the cable chamber 16, together with a carrier 17 and five idlers 18. The flexible flat cable 4 is formed by a strip-shaped member where a plurality of conductors of copper etc. are disposed on one side of a base film of an insulating tape, such as PET. The carrier 17 in the form of a ring is rotatably arranged in the cable chamber 16. Five idlers 18 are rotatably supported at regular intervals by the carrier 17. In accordance with a predetermined winding procedure, the flexible flat cable 14 is accommodated in the cable chamber 16 so as to allow a rotation of the rotor 3 while being guided by the idlers 18. In the flexible flat cable 14, its one end on the outer circumferential side is connected to the stationary connecter part 10*d* of the stator 2, while the other end on the inner circumferential side is connected to the rotary connector parts 12*c*.

As shown in FIG. 4, the slip ring mechanism 5 comprises conductive rings 20, 20 and sliding terminals 21, 21 in two pairs. The two conductive rings 20, 20 are fixed on the stationary top face part 10*b* of the stator 2 concentrically about the rotating center of the rotor 3. The two sliding terminals 21, 21 are fixed on the backside of the stationary stationary top face part 10*b* of the rotor 3. The sliding terminals 21, 21 are positioned so as to slide on the conductive rings 20, 20. As shown in FIGS. 5 and 6, each of the sliding terminals 21, 21 comprises an attachment part 21*a* and a pair of circular arm parts 21*b*, 21*b* extending from the attachment part 21*a* left and right. The attachment parts 21*a* of the terminals 21, 21 are fixed on ribs 12*d* on the rotary top face part 12*a* (see FIG. 5). In each terminal 21, the arm parts 21*b*, 21*b* have their respective tips brought into contact with the conductive ring 20 under pressure due to their elastic force. The sliding terminals 21, 21 are electrically connected to the rotary connector parts 12*c*, while the conductive rings 20, 20 are electrically connected to the stationary connector part 10*d*.

The rotary connector device 1 of the invention operates as follows. When the steering wheel is rotated, the rotor 3 rotates in relation to the stator 2. For this rotation of the rotor 3, the flexible flat cable 4 maintains its electrical connection while changing its accommodated state in the cable chamber 16. On the other hand, the sliding terminals 21, 21 also maintain their electrical connections while sliding on the conductive rings 20, 20. In this way, the electrical connection between the steering column and the steering wheel is effected by the rotary connector device 1 of the embodiment.

In the rotary connector device 1, as described before, the stator 2 is provided with the stationary stationary top face part 10*b* for covering the upside of the cable chamber 16, while the rotor 3 is also provided with the rotary top face part 12*a*. The slip ring mechanism 5 is provided in a clearance between the stationary stationary top face part 10*b* and the rotary top face part 12*a*. That is, the arrangement of the slip ring mechanism 5 allows the conductive rings 20, 20 to be fixed on the stationary top face part 10*b* directly and allows the sliding terminals 21, 21 to be fixed on the rotary top face part 12*a* directly. Therefore, according to the embodiment, since there is no need of preparing any attachment component besides the conductive rings 20, 20 and the sliding terminals 21, 21, it is possible to reduce the number of components forming the rotary connector, saving its manufacturing cost. Thus, there is no need to add an exclusive attachment part, such as brim part in prior art, to the connector device. Additionally, since the provision of the slip ring mechanism 5 is accomplished with the use of the clearance between the stationary top face part 10*b* and the rotary top face part 12*a*, it is possible to install the slip ring mechanism 5 in an axial narrow space, whereby the rotary connector device 1 can be small-sized.

Additionally, since the slip ring mechanism 5 is arranged between the stationary top face part 10*b* covering the upside of the cable chamber 16 and the rotary top face part 12*a*, the same mechanism 5 is not exposed to the outside, suppressing an invasion of foreign particles and an occurrence of noise and/or sliding sound.

In this embodiment, the stator 2 is fixed to the steering column, while the rotor 3 is fixed to the steering wheel and furthermore, the rotary top face part 12*a* of the rotor 3 is positioned above the stationary top face part 10*b* of the stator 2. Under condition that the rotary connector device 1 is assembled in a vehicle, downward pressure is applied from the steering wheel to the rotor 3, urging the sliding terminals 21, 21 against the conductive rings 20, 20. Therefore, it is possible to prevent the device 1 from chattering due to vibrations etc. Additionally, since the flexible flat cable 4 in the stator 2 can be connected to the steering wheel through the rotor 3 just below it, it is possible to reduce an adverse effect (e.g. noise) of great current flowing in the slip ring mechanism 5 on the flexible flat cable 4, adjacent wires, electronic components (not shown), etc.

It will be understood by those skilled in the art that the foregoing descriptions are nothing but one embodiment of the disclosed rotary connector device and therefore, various changes and modifications may be made without any departure from the present purpose of the invention. For instance, in the slip ring mechanism 5, the sliding terminals 21, 21 may be fixed on the stationary top face part 10*b* while fixing the conductive rings 20, 20 on the rotary top face part 12*a*. Additionally, in a modification of the shown arrangement where the sliding terminals 21, 21 are fixed on the ribs 12*d* of the rotary top face part 12*a*, the sliding terminals 21, 21 may be fixed on a part of the shaft part 12*b* (see a part B of FIG. 4), which is exposed to the clearance between the stationary top face part 10*b* and the rotary top face part 12*a*.

In the shown embodiment, the slip ring mechanism 5 comprises the conductive rings 20, 20 and the sliding terminals 21, 21 in two pairs. As for the number of pairs each consisting of the conductive ring 20 and the sliding terminal 21, of course, the slip ring mechanism 5 may comprise a single pair, three or more pairs. Further, although the rotary connector device of the invention is applied to an electrical connection between the steering column and the steering wheel, of course, the rotary connector device of the invention is applicable to any other parts effecting an electrical connection between the stator and the rotor.

What is claimed is:

1. A rotary connector device comprising:

a stator;

a rotor rotatably fitted to the stator, the rotor comprising an upper rotary member and a lower rotary member;

a cable chamber surrounded by the stator and the upper rotary member of the rotor and formed circumferentially around the lower rotary member, which is a rotatable center of the rotor;

a cable in the cable chamber so as to allow rotating of the rotor in relation to the stator, the cable having one end connected to the stator and another end connected to the rotor; and a slip ring mechanism comprising at least one conductive ring and at least one sliding terminal, wherein the at least one conductive ring is fixed to one of the rotor and the stator, and wherein the at least one sliding terminal is fixed to the other of the rotor and the stator and is also configured to slip on the conductive ring;

wherein the stator has a stationary top face part which covers an upside of the cable chamber, while the rotor has a rotary top face part formed so as to adjoin the stationary top face part of the stator; and wherein the slip ring mechanism is in a clearance between the stationary top face part of the stator and the rotary top face part of the rotor.

2. The rotary connector device as claimed in claim 1, wherein:

at least one conductive ring of the slip ring mechanism is fixed to the stationary top face part of the stator, while the at least one sliding terminal of the slip ring mechanism is fixed to the rotary top face part of the rotor.

3. The rotary connector device as claimed in claim 1, wherein:

the stator comprises a cylindrical main housing and an annular under plate assembled to a bottom face of the cylindrical main housing;

the rotor comprises an upper rotary member having a shaft part formed so as to penetrate both of the cylindrical main housing and the annular under plate of the stator and a lower rotary member for engagement with the shaft part of the upper rotary member; and the stator is interposed between the upper rotary member and the lower rotary member of the rotor.

4. The rotary connector device as claimed in claim 3, wherein:

the cable chamber is defined between an outer circumferential wall forming the cylindrical main housing of the stator and an inner circumferential wall forming the shaft part of the upper rotary member of the rotor.

5. The rotary connector device as claimed in claim 1, wherein:

the slip ring mechanism comprises a plurality of conductive rings arranged about the rotating center of the rotor concentrically and a plurality of sliding terminals corresponding to the conductive rings respectively.

6. The rotary connector device as claimed in claim 1, further comprising a ring-shaped carrier accommodated in the cable chamber to carry the cable and a plurality of idlers rotatably carried by the ring-shaped carrier, wherein the cable is a flexible flat cable.

7. The rotary connector device as claimed in claim 1, further comprising a steering wheel of a vehicle and a steering column of the vehicle, wherein the stator is fixed to the steering column, while the rotor is fixed to the steering wheel.

* * * * *